US009488936B2

(12) United States Patent
Michishita et al.

(10) Patent No.: US 9,488,936 B2
(45) Date of Patent: Nov. 8, 2016

(54) IMAGE FORMING APPARATUS

(71) Applicant: KYOCERA Document Solutions Inc., Osaka (JP)

(72) Inventors: Yasuhiro Michishita, Osaka (JP); Satoshi Uemura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/049,536

(22) Filed: Feb. 22, 2016

(65) Prior Publication Data

US 2016/0252851 A1 Sep. 1, 2016

(30) Foreign Application Priority Data

Feb. 27, 2015 (JP) ..... 2015-039143
Feb. 27, 2015 (JP) ..... 2015-039148

(51) Int. Cl.
*G03G 15/16* (2006.01)
*G03G 15/00* (2006.01)
*G03G 21/20* (2006.01)

(52) U.S. Cl.
CPC ..... *G03G 15/1665* (2013.01); *G03G 15/80* (2013.01); *G03G 21/203* (2013.01)

(58) Field of Classification Search
USPC ..... 399/38, 42, 44, 66, 122, 297, 298, 302, 399/303
See application file for complete search history.

(56) References Cited

U.S. PATENT DOCUMENTS 5,974,281 A * 10/1999 Fujii ..... G03G 15/1605 399/302
6,934,499 B1 * 8/2005 Sato ..... G03G 15/1605 399/101
2015/0037054 A1 * 2/2015 Nagata ..... G03G 15/5058 399/49

FOREIGN PATENT DOCUMENTS

JP 2002-31960 1/2002

* cited by examiner

*Primary Examiner* — Hoan Tran
(74) *Attorney, Agent, or Firm* — Wenderoth, Lind & Ponack, L.L.P.

(57) ABSTRACT

In printing, a first power supply unit applies a transfer current with a polarity opposite to a charged polarity of toner to the transfer roller. A second power supply unit applies a toner scattering suppression current with a polarity opposite to the charged polarity of the toner to a stretching roller until a rear end of a sheet passes through a separation position after a front end of the sheet reaches the separation position. The first power supply unit applies a post-transfer current, which has a polarity opposite to the charged polarity of the toner and has an absolute value equal to or more than an absolute value of the toner scattering suppression current, to the transfer roller until the rear end of the sheet passes through the separation position after the rear end of the sheet passes through the nip position.

5 Claims, 13 Drawing Sheets

Fig.6

| | Atmospheric condition K1 | Atmospheric condition K2 | Atmospheric condition K3 |
|---|---|---|---|
| Temperature(°C) | 10 | 23 | 32 |
| Relative humidity(%) | 10 | 50 | 80 |
| Absolute humidity(kg/kg) | 1 | 10 | 27 |
| Toner scattering suppression current(μA) | −10 | −6 | −2 |
| Transfer current(μA) | −70 | −150 | −250 |

Fig.10

| | Toner scattering suppression bias | In-apparatus contamination | | Belt resistance value (log Ω) | Belt life |
|---|---|---|---|---|---|
| | | 20K sheets | 600K sheets | | |
| Embodiment 1 | Downstream side roller | ○ | ○ | 7.83 | ○ |
| Modification | Downstream side roller | ○ | ○ | 7.82 | ○ |
| Embodiment 2 | Downstream side roller and guide member | ○ | ○ | 7.82 | ○ |
| Conventional example | None | ○ | × | 7.81 | ○ |

Fig.12

| | Resistance value of resistance unit (Ω) | Resistance value of conveying belt (Ω) | Scattered toner confirmation result | Absolute value of current value (μA) | |
|---|---|---|---|---|---|
| | | | | Branch point ~ downstream side roller (first current path) | Branch point ~ guide member (second current path) |
| Embodiment 1 | 1MΩ | 10^7.25 | △ | 4～6 | 7～10 |
| Embodiment 2 | 10MΩ | 10^7.25 | ○ | 7～8 | 7～9 |
| Embodiment 3 | 100MΩ | 10^7.25 | ○ | 7～8 | 7～8 |
| Embodiment 4 | Material equal to conveying belt | 10^7.25 | ○ | 6～8 | 6～8 |
| Comparison example 1 | None | 10^7.25 | × | 3～5 | 7～9 |

IMAGE FORMING APPARATUS

CROSS-REFERENCE TO RELATED APPLICATION

This application is based upon and claims the benefit of priority from Japanese Patent Application No. 2015-039143 filed on Feb. 27, 2015 and No. 2015-039148 filed on Feb. 27, 2015, the entire contents of which are incorporated herein by reference.

BACKGROUND

The technology of the present disclosure relates to an image forming apparatus.

Conventionally, It has been known that an image forming apparatus includes a photosensitive drum, a conveying belt that conveys a sheet, and a transfer roller brought into press-contact with the photosensitive drum while interposing the conveying belt between the photosensitive drum and the transfer roller. The aforementioned sheet is conveyed to a downstream side while being nipped by the conveying belt and the photosensitive drum. The transfer roller receives a transfer current with a polarity opposite to a charged polarity of toner when the sheet passes through a nip position. In this way, a toner image carried on the photosensitive drum is transferred to the sheet. At a downstream side of a sheet conveyance direction from the aforementioned nip position, a stretching roller is provided. The stretching roller stretches the conveying belt at a separation position at which the sheet is separated from the conveying belt.

SUMMARY

An image forming apparatus according to one aspect of the present disclosure includes an image carrier, a conveying belt, a transfer roller, a stretching roller, and a first power supply unit. The image carrier carries a toner image. The conveying belt forms a nip in contact with the aforementioned image carrier and conveys a sheet via a nip position. The transfer roller transfers the aforementioned toner image to the aforementioned sheet at the aforementioned nip position. The stretching roller stretches the aforementioned conveying belt at a separation position which corresponds to a downstream side of a sheet conveyance direction from the aforementioned nip position and at which the aforementioned sheet is separated from the conveying belt. The first power supply unit applies a transfer current with a polarity opposite to a charged polarity of toner to the aforementioned transfer roller until a rear end of the sheet passes through the nip position after a front end of the aforementioned sheet reaches the aforementioned nip position.

Furthermore, the aforementioned image forming apparatus further includes a second power supply unit. The second power supply unit applies a toner scattering suppression current with a polarity opposite to the charged polarity of the toner to the aforementioned stretching roller until the rear end of the aforementioned sheet passes through the separation position after the front end of the aforementioned sheet reaches the separation position. The first power supply unit is configured to apply a post-transfer current, which has a polarity opposite to the charged polarity of the toner and has an absolute value equal to or more than an absolute value of the aforementioned toner scattering suppression current, to the aforementioned transfer roller until the rear end of the aforementioned sheet passes through the separation position after the rear end of the aforementioned sheet passes through the aforementioned nip position.

BRIEF DESCRIPTION OF THE DRAWINGS

FIG. 6 is table data used when deciding a toner scattering suppression current and a transfer current in a controller.

FIG. 10 is a table illustrating a result obtained by performing a print test by using image forming apparatuses of embodiments 1, 2 and a modification.

FIG. 12 is a table illustrating a result obtained by performing a continuous print test by changing a resistance value of a resistance member to various values in a modification of an embodiment 2.

DETAILED DESCRIPTION

Hereinafter, an example of an embodiment will be described in detail on the basis of the drawings. It is noted that the technology of the present disclosure is not limited to the following embodiments.

Embodiment 1

Figure 1:
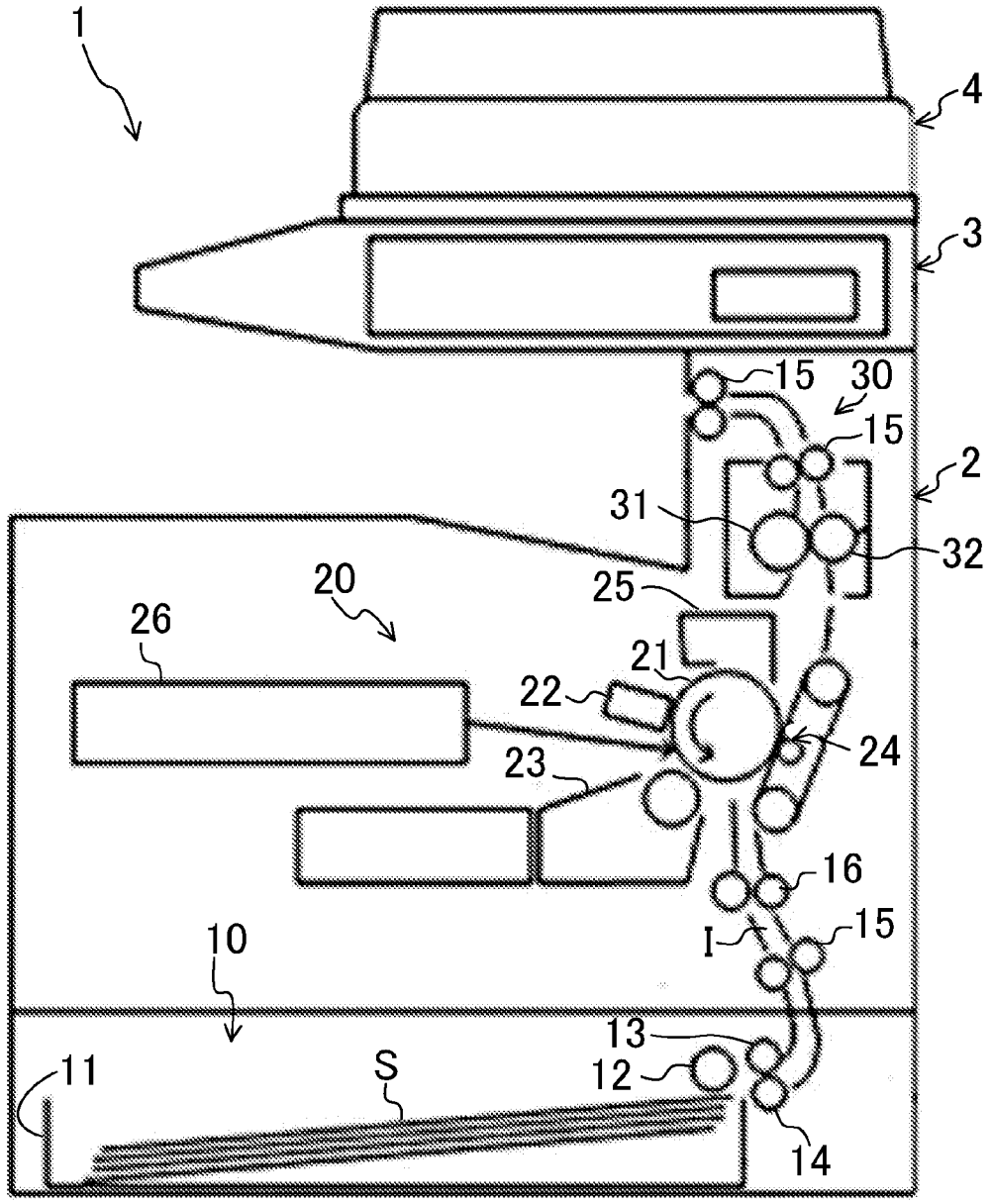
FIG. 1 is a schematic view illustrating a configuration of an image forming apparatus of an embodiment.

FIG. 1 illustrates a monochrome copy machine which is an example of an image forming apparatus 1 in an embodiment 1. The image forming apparatus 1 includes a casing 2, an image reading unit 3, and an ADF (automatic document feeder) 4. The image reading unit 3 is mounted at an upper end portion of the casing 2, and the ADF is arranged so as to cover a document placement surface of the image reading unit 3. The image reading unit 3 has a light source, a reflective mirror, a CCD (Charge Coupled Device) and the like, and optically reads an image of a document set on the document placement surface or an image of a document supplied by the ADF. The image reading unit 3 converts the read document image into data and transmits the data to an image forming unit 20 to be described later.

The aforementioned casing 2 has a paper feeding unit 10, the image forming unit 20, and a fixing unit 30 therein. The paper feeding unit 10 is provided at a bottom portion of the casing 2. The paper feeding unit 10 includes a paper feeding cassette 11 that accommodates a plurality of sheets S overlapping one another, a pick roller 12 that takes out the sheets S in the paper feeding cassette 11 one by one, and a feed roller 13 and a retard roller 14 that separate the taken-out sheets S one by one and send the separated sheet S to a conveyance path T.

The image forming unit 20 is provided above the paper feeding unit 10 in the housing 2. The image forming unit 20 includes a photosensitive drum (an image carrier) 21 serving as an image carrier provided so as to be rotatable in the housing 2, a charging device 22, a developing device 23, a transfer device 24, and a cleaning device 25, which are arranged around the photosensitive drum 21, and an optical scanning device 26 arranged above the photosensitive drum 21.

The fixing unit 30 is arranged above the image forming unit 20. The fixing unit 30 has a fixing roller 31 heated by a heating device such as a heater and a pressure roller 32 brought into press-contact with the fixing roller 31.

In the image forming unit 20, when image data is received by the image reading unit 3, the photosensitive drum 21 is rotationally driven by a motor (not illustrated) and the surface of the photosensitive drum 21 is charged to a predetermined potential by the charging device 22. In the present embodiment, the charging device 22 charges the surface of the photosensitive drum 21 to a positive polarity. In this way, after the surface of the photosensitive drum 21 is charged, laser light is emitted from the optical scanning device 26 to the photosensitive drum 21 on the basis of image data from the image reading unit 3. The laser light is irradiated to the surface of the photosensitive drum 21, so that an electrostatic latent image is formed. The electrostatic latent image formed on the photosensitive drum 21 is developed by charged toner in the developing device 23 and is visualized as a toner image. In the present embodiment, a toner image is formed by so-called inversion development and a charged polarity of charged toner becomes a positive polarity (a polarity equal to the charged polarity of the surface of the photosensitive drum 21) in the developing device 23. It is noted that a toner image may also be formed by normal development as well as the inversion development, and in this case, a charged polarity of toner becomes a negative polarity.

After a toner image is formed on the surface of the photosensitive drum 21, the sheet S sent from a resist roller pair 16 is pressed to the surface of the photosensitive drum 21 by the transfer device 24. A transfer current having a charged polarity (a negative polarity in the present embodiment) opposite to a toner polarity is applied to the sheet S by the transfer device 24, so that the toner image of the photosensitive drum 21 is transferred to the sheet S. The sheet S with the transferred toner image is heated and pressed by the fixing roller 31 and the pressure roller 32 in the fixing unit 30. As a consequence, the toner image is fixed to the sheet S.

Figure 2:
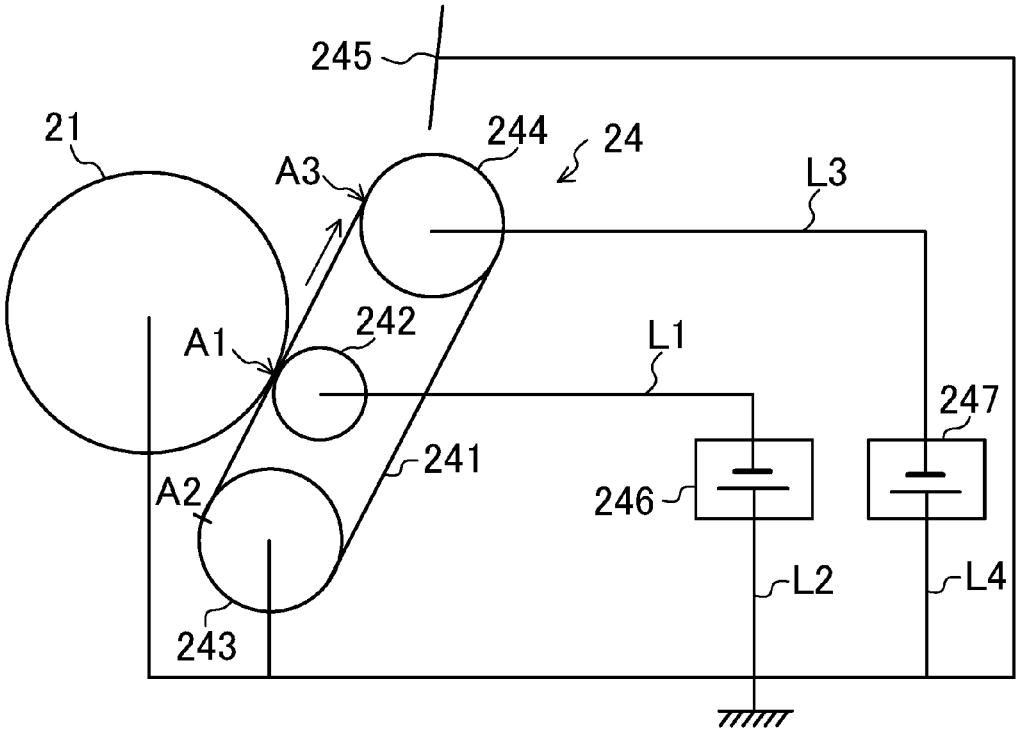
FIG. 2 is a schematic view illustrating a configuration of a transfer device.

As illustrated in FIG. 2, the transfer device 24 has an endless conveying belt 241, a transfer roller 242, an upstream side roller 243, a downstream side roller (a stretching roller) 244, a first power supply unit 246, and a second power supply unit 247.

The conveying belt 241 conveys the sheet S while electrostatically attracting the sheet S on the outer peripheral surface thereof. The outer peripheral surface of the conveying belt 241 makes contact with the photosensitive drum 21 to form a nip between the photosensitive drum 21 and the conveying belt 241. The conveying belt 241 is stretched to the upstream side roller 243 and the downstream side roller 244 at a predetermined tension. The upstream side roller 243 or the downstream side roller 244 is rotationally driven by a motor (not illustrated), so that the conveying belt 241 is driven in a direction indicated by an arrow of FIG. 2. The conveying belt 241, for example, is formed by coating a fluorine-based resin on the outer peripheral surface of a belt-shaped member made of rubber.

The transfer roller 242 is arranged facing the photosensitive drum 21. An outer peripheral surface of the transfer roller 242 is brought into contact with an inner peripheral surface of the conveying belt 241. The transfer roller 242 is brought into press-contact with the photosensitive drum 21 with predetermined load while interposing the conveying belt 241 between the photosensitive drum 21 and the transfer roller 242. In this way, the sheet S is nipped between the conveying belt 241 and the photosensitive drum 21 at a nip position A1. Furthermore, the transfer roller 242 applies a transfer current C1 with a polarity opposite to a charged polarity of toner to the sheet S passing through the nip position A1, thereby transferring the toner image to the sheet S.

The upstream side roller 243 stretches the conveying belt 241 at a conveyance start position A2, at which a front end of the sheet S approaches the conveying belt 241, wherein the conveyance start position A2 corresponds to an upstream side in a sheet conveyance direction of the nip position A1. The upstream side roller 243 is formed by a conductive member such as a metal and is grounded via a bearing and the like. It is noted that the front end and the rear end of the sheet S indicate the front end and the rear end of the sheet S in the sheet conveyance direction in the present embodiment.

The downstream side roller (the stretching roller) 244 stretches the conveying belt 241 at a separation position A3, at which the rear end of the sheet S is separated from the conveying belt 241, wherein the separation position A3 corresponds to a downstream side of the sheet conveyance direction from the nip position A1. The downstream side roller 244 is formed by a conductive member such as a metal.

At the downstream side of the downstream side roller 244 in the sheet conveyance direction, a guide member 245 is provided. The guide member 245 leads the sheet S, which has been separated from the conveying belt 241 at the separation position A3, to the fixing unit 30. The guide member 245 is configured by a conductive member such as a metal. The guide member 245 is grounded in the present embodiment. It is noted that a current with a polarity opposite to a charged polarity of toner may also be applied to the guide member 245 as will be described later.

Figure 3:
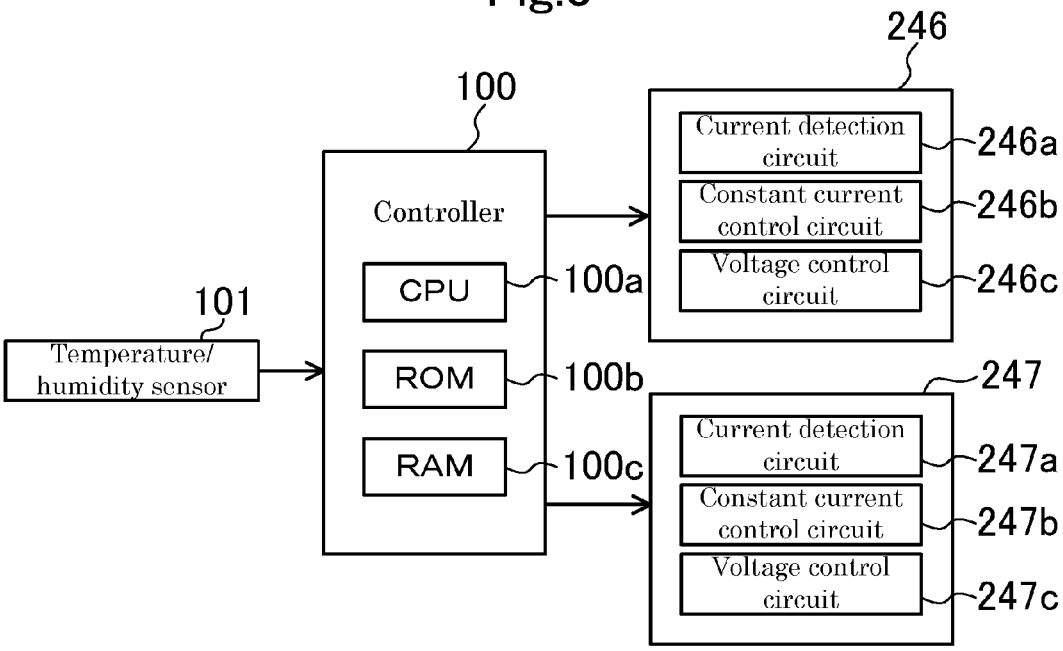
FIG. 3 is a block diagram illustrating a configuration of a control system that controls first and second power supply units connected to a transfer device.

The first power supply unit 246 applies any one of the transfer current C1, a post-transfer current C2, and a standby current C3 to the transfer roller 242. A negative electrode side terminal of the first power supply unit 246 is connected to the transfer roller 242 via a wiring L1, and a positive electrode side terminal of the first power supply unit 246 is grounded via a wiring L2. As illustrated in FIG. 3, the first power supply unit 246 has a current detection circuit **246*a*, a constant current control circuit 246*b*, and a voltage control circuit 246*c*. The current detection circuit 246*a* detects an output current (that is, a current applied to the transfer roller 242 via the wiring L1) of the first power supply unit 246. The constant current control circuit 246*b* adjusts an output current of the voltage control circuit 246*c* such that the current detected by the current detection circuit 246*a* is equal to a target current decided by a controller (a control unit) 100. In this way, the first power supply unit 246 applies the aforementioned currents C1 to C3 to the transfer roller 242** by constant current control.

Herein, the transfer current C1 is a current with a polarity opposite to a charged polarity of toner and is a current for transferring the toner image of the photosensitive drum 21 to the sheet S. The post-transfer current C2 is a current with a polarity opposite to the charged polarity of the toner and is a current for preventing a toner scattering suppression current C4, which will be described later, from flowing out to the transfer roller 242 side through the conveying belt 241. In the present embodiment, an absolute value of the post-transfer current C2 is smaller than an absolute value of the transfer current C1. The standby current C3 is a current with a polarity equal to the charged polarity of the toner and is a current for preventing toner from being attached to the conveying belt 241 at the time of non-image formation. The absolute values and application timings of the transfer current C1, the post-transfer current C2, and the standby current C3 are controlled by the controller 100.

The second power supply unit 247 applies the toner scattering suppression current C4 to the downstream side roller 244. A negative electrode side terminal of the second power supply unit 247 is connected to the downstream side roller 244 via a wiring L3, and a positive electrode side terminal of the second power supply unit 247 is grounded via a wiring L4. The second power supply unit 247 has a current detection circuit 247*a*, a constant current control circuit 247*b*, and a voltage control circuit 247*c*, similarly to the first power supply unit 246. The second power supply unit 247 applies the toner scattering suppression current C4 to the downstream side roller 244 by constant current control.

The scattering suppression current C4 is a current with a polarity opposite to the charged polarity of the toner, and plays a role of suppressing separation discharge due to the separation of the sheet S and allowing toner to be held by the sheet S. The absolute value and application timing of the toner scattering suppression current C4 are controlled by the controller 100.

The controller 100 includes a micro computer having a CPU 100*a*, a ROM 100*b*, a RAM 100*c* and the like. The controller 100 controls a print operation and a sheet conveyance operation on the basis of detection signals from various sensors. Furthermore, the controller 100 controls the output currents of the first power supply unit 246 and the second power supply unit 247 on the basis of a detection signal from a temperature/humidity sensor and table data (see FIG. 6) stored in the ROM.

The temperature/humidity sensor 101, for example, is provided around the image forming unit 20. The temperature/humidity sensor 101 detects atmospheric temperature, relative humidity, and absolute humidity and outputs these detection signals to the controller 100.

The aforementioned table data (see FIG. 6) is obtained by setting the transfer current C1 and the toner scattering suppression current C4 in advance with respect to each of three atmospheric conditions K1 to K3, in which the atmospheric temperature, the relative humidity and the absolute humidity are different from one another, and put the data in a table. As apparent from the table data, the absolute value of the toner scattering suppression current C4 is set to a high value as the absolute humidity or relative humidity of the air is low (that is, the resistance of the sheet S is large). In other words, the absolute value of the toner scattering suppression current C4 is set to be high as the occurrence probability of the separation discharge of the sheet S is high. It is noted that each current value is set with respect to the three atmospheric conditions K1 to K3 in the present embodiment; however, the technology of the present disclosure is not limited thereto and for example, the atmospheric conditions may also be further subdivided and the aforementioned each current value may also be set with respect to four or more atmospheric conditions.

Herein, when the temperature, the relative humidity, and the absolute humidity detected by the temperature/humidity sensor 101 do not satisfy any one of the aforementioned atmospheric conditions K1 to K3, the controller 100 decides the transfer current C1 and the toner scattering suppression current C4 by linear interpolation.

In a detailed example, for example, when the temperature is 16.5° C. (=a center value of 10° C. and 23° C.), the relative humidity is 10%, and the absolute humidity is 1 kg/1 kg, the controller 100 linearly interpolates each of the current values of the atmospheric condition K1 and the atmospheric condition K2 of the table data, so that the toner scattering suppression current C4 is calculated as −8 μA (={(−10)+(−6)}/2) and the transfer bias current C1 is calculated as −110 μA (={(−70)+(−150)}/2).

The table data does not include the post-transfer current C2 and the standby current C3. The post-transfer current C2 is set as a value equal to the toner scattering suppression current C4 by the controller 100. Furthermore, the standby current C3 is set as a constant value (for example, 50 μA) regardless of the atmospheric conditions.

Figure 4:
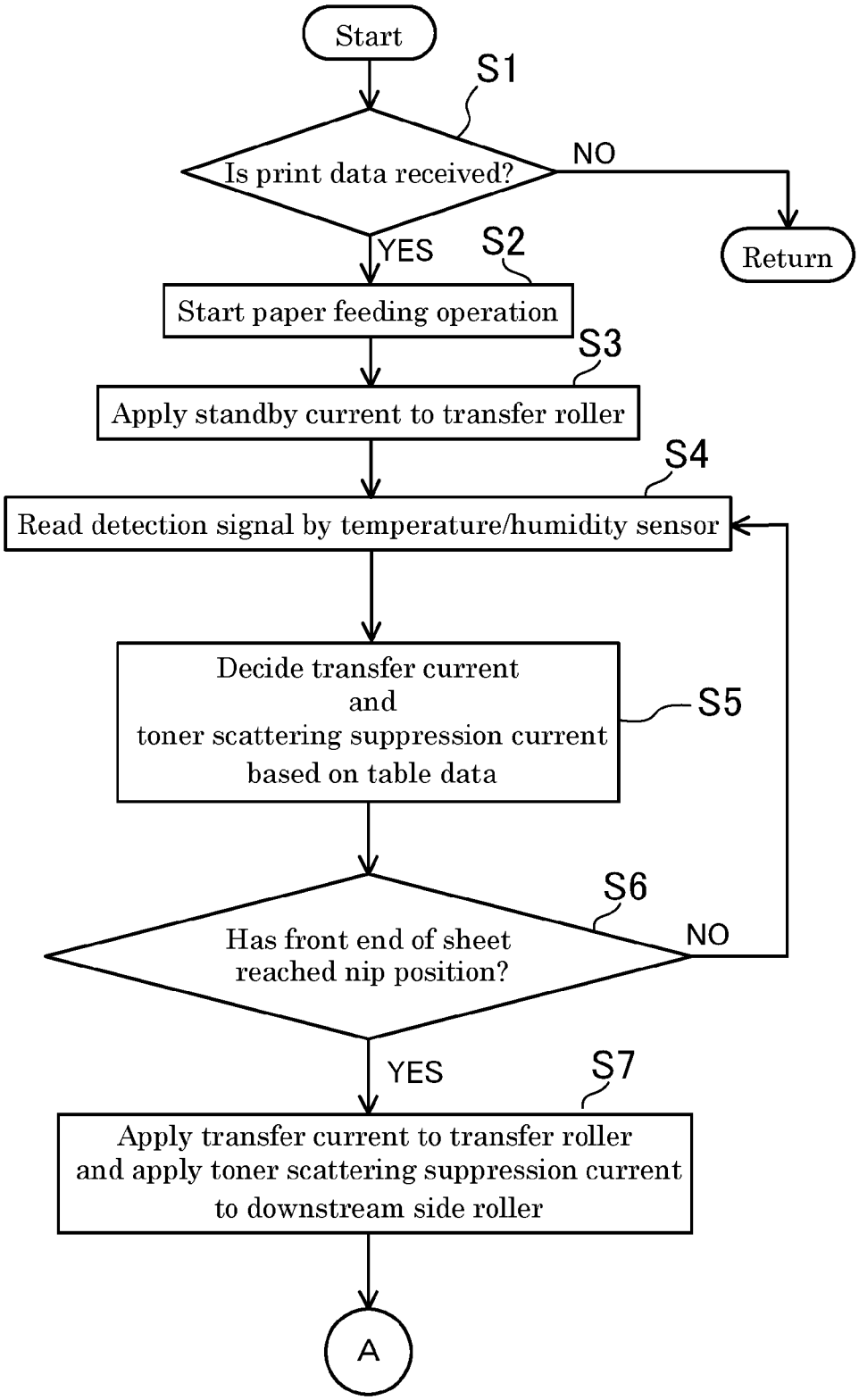
FIG. 4 is a flowchart illustrating a front half part of output current control of first and second power supply units in a controller.
Figure 5:
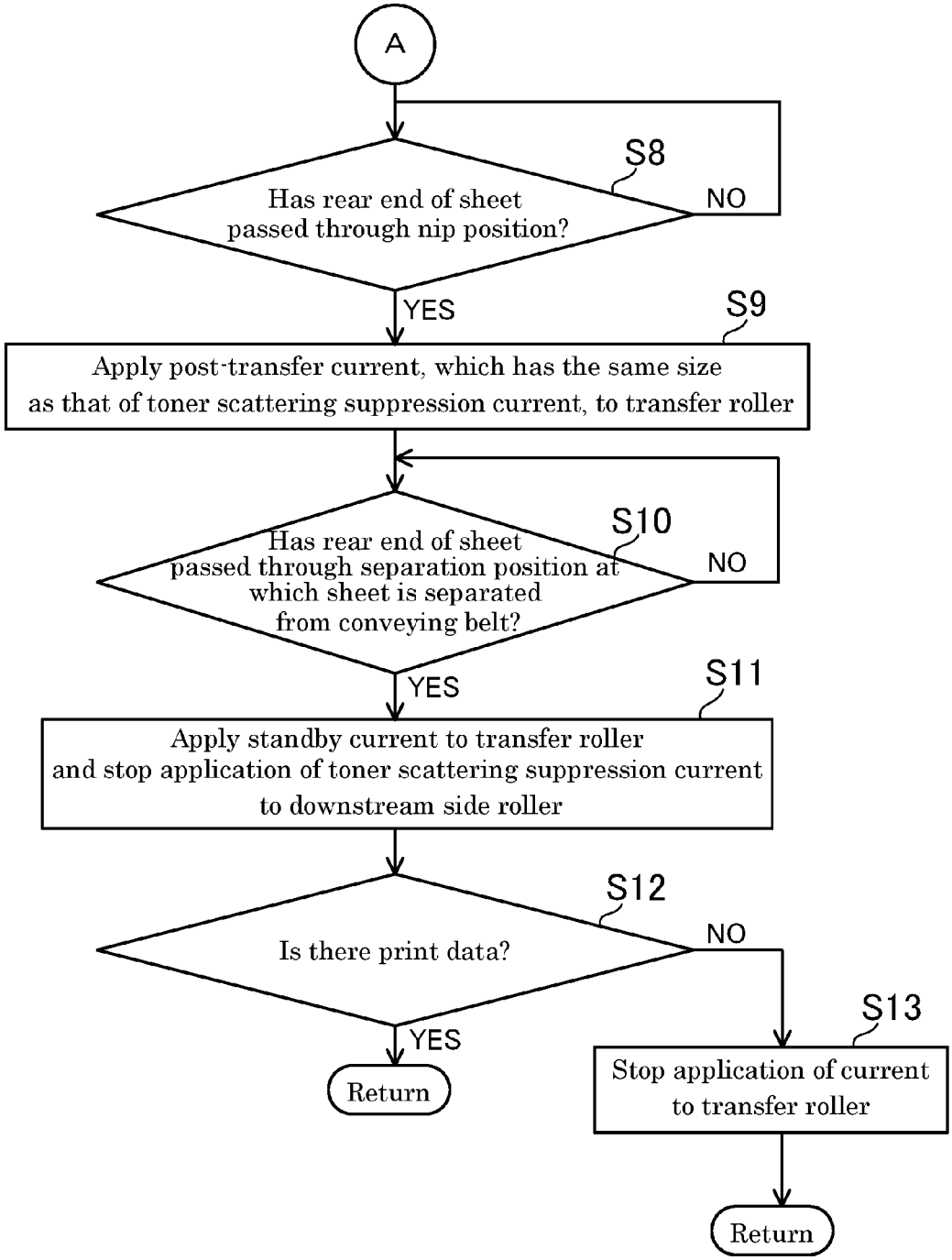
FIG. 5 is a flowchart illustrating a rear half part of output current control of first and second power supply units in a controller.

The current control of the first and second power supply units 246 and 247 by the controller 100 will be described in detail with reference to flowcharts of FIG. 4 and FIG. 5.

In step S1, it is determined whether image data for print (print data) has been received. When the determination is NO, the procedure proceeds to return, and when the determination is YES, the procedure proceeds to step S2.

In step S2, a paper feeding start signal is output to the paper feeding unit 10, so that a paper feeding operation is started.

In step S3, the preset standby current (a current with a polarity equal to a charged polarity of toner) C3 is applied to the transfer roller 242.

In step S4, a detection signal from the temperature/humidity sensor 101 is read and atmospheric temperature, relative humidity, and absolute humidity are calculated on the basis of the read detection signal.

In step S5, on the basis of the aforementioned table data stored in the ROM and the temperature, the relative humidity, and the absolute humidity calculated in step S4, the transfer current C1 and the toner scattering suppression current C4 are decided. This decision procedure is performed by linearly interpolating each of the current values C1 and C4 written as the table data as described above.

In step S6, on the basis of a passage time up to a current time point after the paper feeding operation starts in step S2, it is determined whether the front end of the sheet S has reached the nip position A1. When the determination is NO, the procedure returns to step S4, and when the determination is YES, the procedure proceeds to step S7.

In step S7, a control signal is output to the first power supply unit 246 to apply the transfer current C1 decided in step S5 to the transfer roller 242, and a control signal is output to the second power supply unit 247 to apply the toner scattering suppression current C4 decided in step S5 to the downstream side roller 244.

In step S8 (see FIG. 5), on the basis of a passage time up to a current time point after the front end of the sheet S has reached the nip position in step S6 and length information of the sheet S in the conveyance direction included in the print data, it is determined whether the rear end of the sheet S has passed through the nip position A1. When the determination is NO, the present step S8 is performed again, and when the determination is YES, the procedure proceeds to step S9.

In step S9, a control signal is output to the first power supply unit 246 to apply the post-transfer current C2, which has an absolute value equal to that of the toner scattering suppression current C4 decided in step S5 and has a polarity opposite to a charged polarity of toner, to the transfer roller 242. In this way, the application current to the transfer roller 242 is switched from the transfer current C1 to the post-transfer current C2.

In step S10, on the basis of a passage time up to a current time point after the rear end of the sheet S has passed through the nip position A1 in step S8, it is determined whether the rear end of the sheet S has passed through the aforementioned separation position A3. When the determination is NO, the present step S10 is performed again, and when the determination is YES, the procedure proceeds to step S11.

In step S11, a control signal is output to the first power supply unit 246 to apply the preset standby current C3 to the transfer roller 242. Furthermore, a stop signal is output to the second power supply unit 247 to stop the application of the toner scattering suppression current C4 to the downstream side roller 244.

In step S12, it is determined whether there exist print data to be printed. When the determination is YES, the procedure proceeds to return, and when the determination is NO, the procedure proceeds to step S13.

In step S13, a stop signal is output to the first power supply unit 246 to stop the application of a current to the transfer roller 242, and then return is performed.

Figure 7:
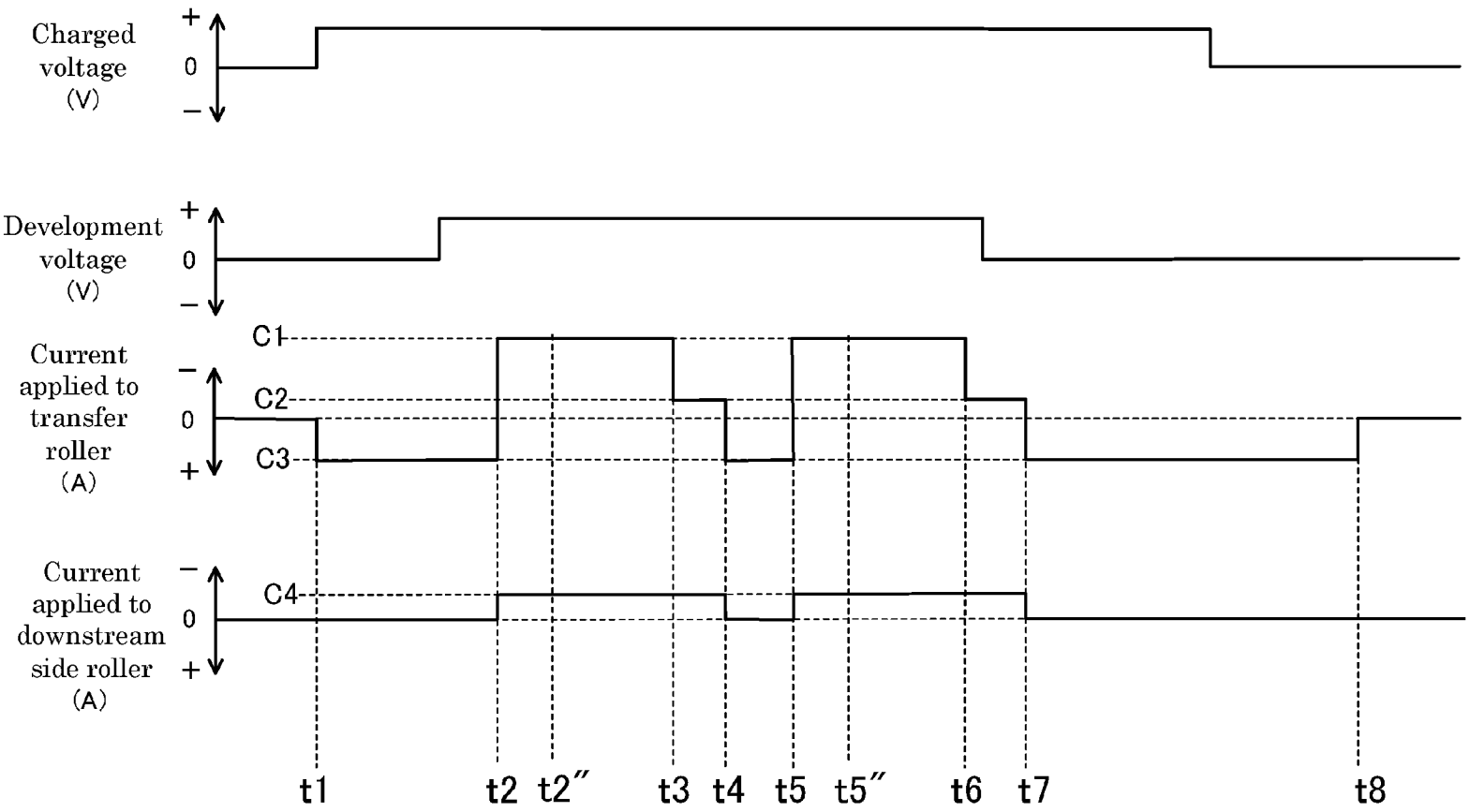
FIG. 7 is a time chart illustrating an example of output current control of first and second power supply units in an embodiment 1.

FIG. 7 is a time chart illustrating an example of the aforementioned current control by the controller 100. The time chart illustrates an example in which continuous print has been performed for two sheets S. When the image forming apparatus 1 receives a print start request, a print operation is started, so that a charged voltage is applied to the surface of the photosensitive drum 21 and then a development voltage is applied in the developing device 23. At a time t1, the image forming apparatus 1 starts the print operation and simultaneously the standby current C3 with a polarity (a positive polarity in the present embodiment) equal to a charged polarity of toner is applied to the transfer roller 242. At a time t2, the front end of the sheet S reaches the nip position A1 and simultaneously the transfer current C1 with a polarity (a negative polarity) opposite to the charged polarity of the toner is applied to the transfer roller 242, and the toner scattering suppression current C4 with a polarity (the negative polarity) opposite to the charged polarity of the toner is further applied to the downstream side roller 244. At a time t2", the front end of the sheet S reaches the aforementioned separation position A3, and at this time, the toner scattering suppression current C4 has been already applied to the downstream side roller 244. At a time t3, the rear end of the sheet S passes through the nip position A1 and simultaneously the application current to the transfer roller 242 is switched from the transfer current C1 to the post-transfer current C2 (which is a current with a polarity opposite to the charged polarity of the toner and has an absolute value equal to that of the toner scattering suppression current C4). At a time t4, the rear end of the sheet S passes through the separation position A3 and simultaneously the application current to the transfer roller 242 is switched from the post-transfer current C2 to the standby current C3, and the application of the toner scattering suppression current C4 to the downstream side roller 244 is stopped. At times t5, t5", t6, and t7, processes equal to those of t2, t2", t3, and t4 are performed at the time of printing of subsequent sheets S. At a time t8, the application of a current to the transfer roller 242 is stopped, so that the print operation is ended.

As described above, in the aforementioned embodiment, until the rear end of the sheet S passes through the separation position A3 after at least the front end of the sheet S has reached the separation position A3, the toner scattering suppression current C4 with the polarity opposite to the charged polarity of the toner is applied to the downstream side roller 244 (steps S7 and S8). Consequently, it is possible to prevent outflow and discharge of charge with a polarity opposite to the charged polarity of the toner to the downstream side roller 244 from the rear end of the sheet S when the rear end of the sheet S is separated at the separation position A3. Accordingly, it is possible to prevent a part of the toner held to the sheet S from being scattered.

Herein, in a conventional image forming apparatus 1, a transfer current with a polarity opposite to a charged polarity of toner is applied to the transfer roller 242 at the time of image formation, and after the rear end of the sheet S passes through the nip position A1, in order to prevent toner adhesion to the conveying belt 241, charge with a polarity equal to the charged polarity of the toner is applied to the transfer roller 242. Therefore, after the rear end of the sheet S passes through the nip position, a charge with a polarity opposite to the charged polarity of the toner flows out toward the transfer roller 242 from the downstream side roller 244 through the conveying belt 241. As a consequence, there is a problem that it is not possible to sufficiently suppress the above-described separation discharge due to the insufficiency of the toner scattering suppression current C4 which is applied to the downstream side roller 244.

However, in the aforementioned embodiment 1, until the rear end of the sheet S passes through the separation position A3 after passing through the nip position A1, the post-transfer current C2, which has a polarity opposite to the charged polarity of the toner and has the same absolute value as that of the toner scattering suppression current C4, is applied to the transfer roller 242. In this way, it is possible to prevent the toner scattering suppression current C4 from flowing out to the transfer roller 242 from the downstream side roller 244 through the conveying belt 241. Accordingly, it is possible to avoid the insufficiency of the toner scattering suppression current C4 and thus to reliably suppress toner on the sheet S from being scattered.

Furthermore, in the aforementioned embodiment 1, the absolute value of the post-transfer current C2 is set to be lower than that of the transfer current C1. In this way, it is possible to prevent the durability life of the conveying belt 241 from being reduced due to the overflow of a current to the conveying belt 241.

Furthermore, in the aforementioned embodiment 1, the controller 100 is configured to increase the absolute value of the toner scattering suppression current C4 and the absolute value of the post-transfer current C2 (the same size as that of the toner scattering suppression current C4) as the atmospheric humidity is high (see FIG. 6).

According to this, the absolute value of the toner scattering suppression current C4 becomes large in an environment in which separation discharge from the rear end of the sheet S occurs, so that it is possible to reliably suppress the separation discharge. Furthermore, since the post-transfer current C2 also becomes large, the toner scattering suppression current C4 does not flow out to the transfer roller 242 side through the conveying belt 241. It is noted that since the absolute value of the toner scattering suppression current C4 becomes small in an environment in which the separation discharge of the sheet S is difficult to occur, it is possible to prevent the toner scattering suppression current C4 and the post-transfer current C2 from being wastefully consumed and to suppress the life reduction of the conveying belt 241 due to the application of the post-transfer current C2.

Modification

Figure 8:
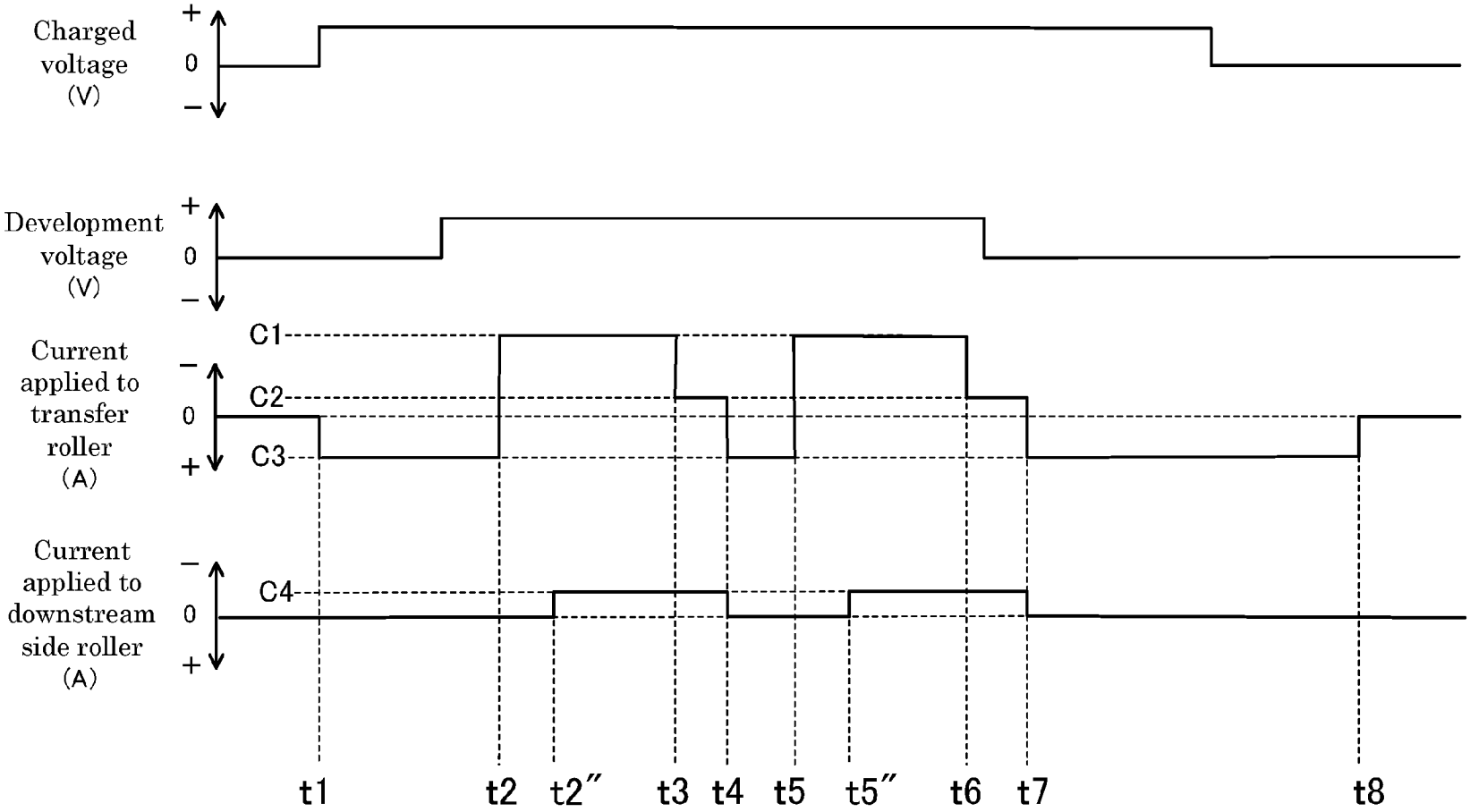
FIG. 8 is a diagram corresponding to FIG. 7, which illustrates a modification of an embodiment 1.

FIG. 8 illustrates a modification of the aforementioned embodiment 1. This modification is different from the aforementioned embodiment 1 in that an application start time of the toner scattering suppression current C4 is the time t2" later than the time t2. That is, in the present modification, the application of the toner scattering suppression current C4 is started from when the front end of the sheet S has reached the separation position A3 from the aforementioned conveying belt 241. In this way, it is possible to obtain the same operation effect as those of the aforementioned embodiment 1 while maximally suppressing the consumption of the toner scattering suppression current C4.

Embodiment 2

Figure 9:
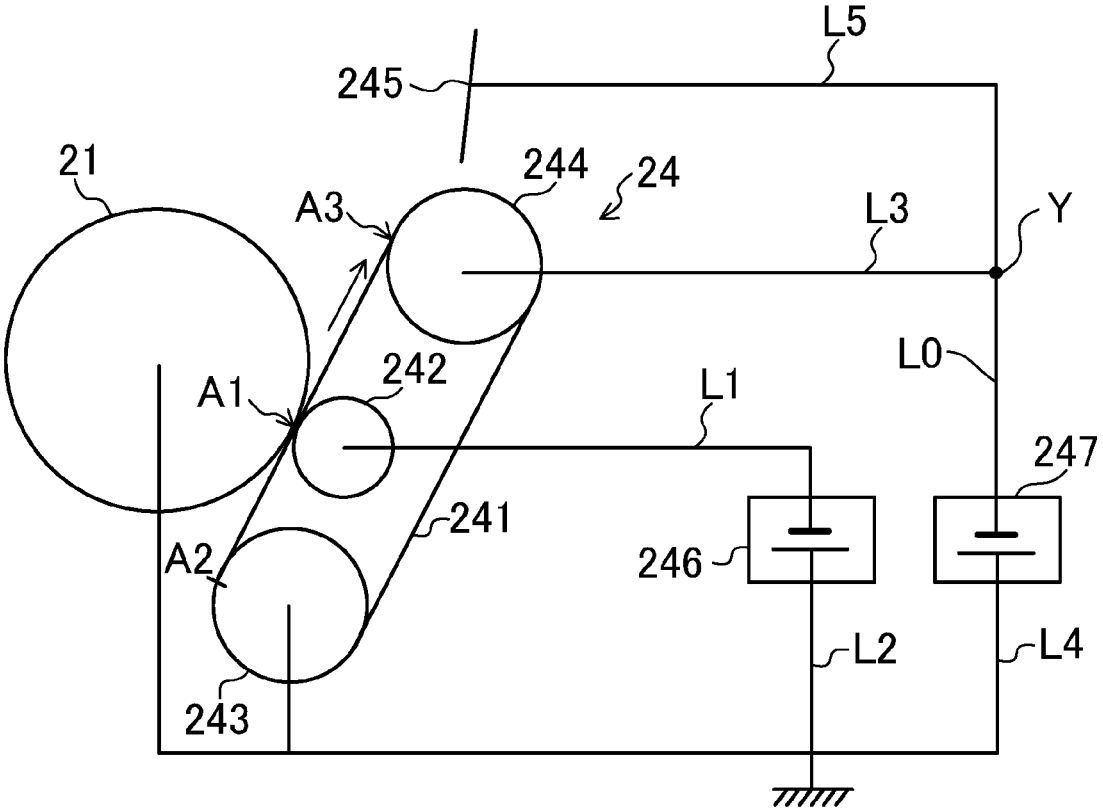
FIG. 9 is a diagram corresponding to FIG. 2, which illustrates an embodiment 2.

FIG. 9 illustrates an embodiment 2. This embodiment is different from the aforementioned embodiment 1 in that the toner scattering suppression current C4 is also applied to the guide member 245 in addition to the downstream side roller 244. That is, in the present embodiment, the guide member 245 is connected to a negative electrode side terminal of the second power supply unit 247 via a wiring L5. The wiring L5 and the aforementioned wiring L3 are connected to a common wiring L0 at a branch point Y and the common wiring L0 is connected to the second power supply unit 247. According to the configuration of the present embodiment 2, it is possible to supply charge with a polarity opposite to a charged polarity of toner to the sheet S by micro discharge from a downstream side end portion of the guide member 245 in the sheet conveyance direction. Thus, it is possible to more reliably suppress scattering of toner from the sheet S.

Print Test Results of Each Embodiment and Modification

In the image forming apparatuses 1 of the aforementioned embodiments 1, 2 and the aforementioned modification, a continuous print test has been performed on 600 K (K=1000) sheets S having an A4 size. FIG. 10 is a table illustrating the test results. In the table, the "O" indicates that the amount of scattered toner in the image forming apparatuses 1 measured by a sensor is smaller than a reference value, and the "X" indicates that the amount of the scattered toner is equal to or more than the reference value. The "belt resistance value" is a value obtained by measuring the resistance value of the conveying belt 241. The "O" of the "belt life" column indicates that the belt resistance value is equal to or less than the reference value (7.85 log Ω in the present test) and the belt life is sufficient. As apparent from the table of FIG. 10, in a conventional example in which the post-transfer current C2 is not applied, after the 600 K sheets S are printed, the amount of the scattered toner in the image forming apparatuses 1 is equal to or more than the reference amount, but in the image forming apparatuses 1 of the aforementioned embodiments 1, 2 and the aforementioned modification, the amount of the scattered toner is suppressed to be smaller than the reference amount.

Modification

Figure 11:
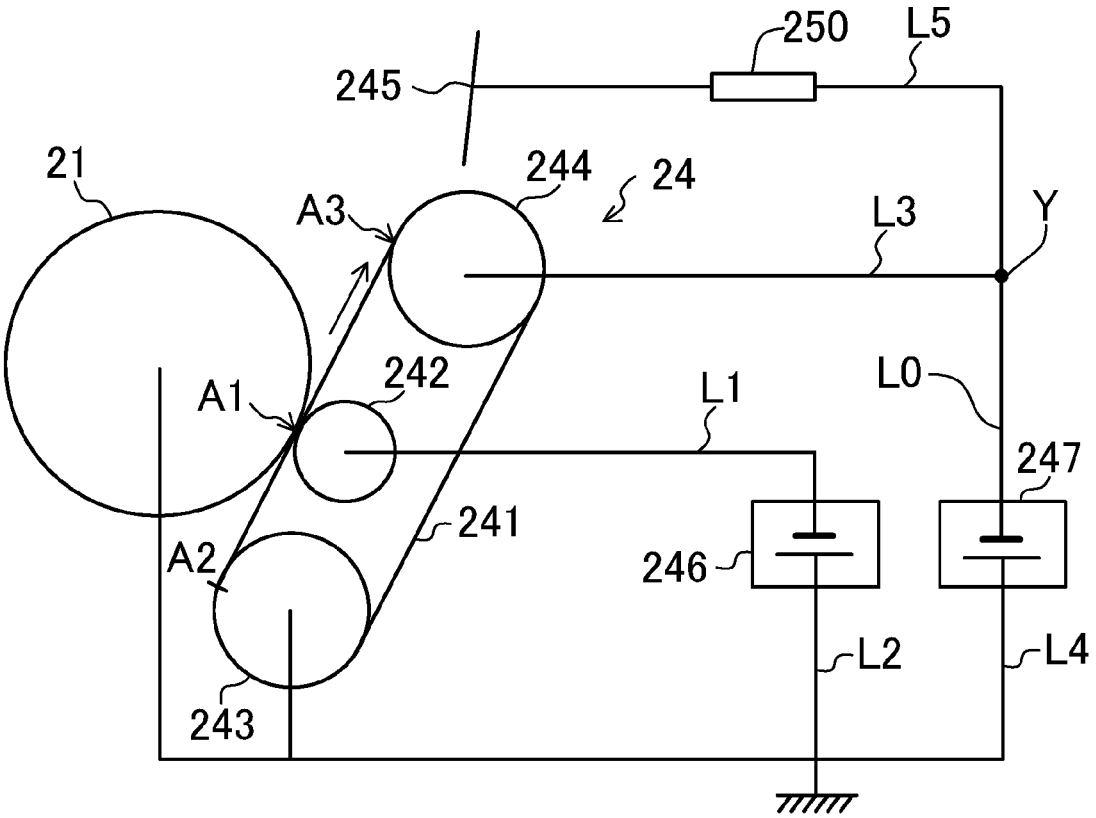
FIG. 11 is a diagram corresponding to FIG. 2, which illustrates a modification of an embodiment 2.

FIG. 11 illustrates a modification of the embodiment 2. This modification is different from the embodiment 2 in that a resistance unit 250 is provided halfway of the wiring L5. The resistance unit 250, for example, is configured by serially arranging a material, which is equal to that of the conveying belt 241 and has the same thickness as that of the conveying belt 241, with respect to a current path.

The second power supply unit 247 has a current detection circuit 247*a*, a constant current control circuit 247*b*, and a voltage control circuit 247*c* as described above. The second power supply unit 247 outputs a preset setting current C5 by constant current control. A part (=C41) of the setting current C5 is supplied to the downstream side roller 244 as a first toner scattering suppression current C41, and a remaining current (=C42) is supplied to the guide member 245 as a second toner scattering suppression current C42.

The first toner scattering suppression current C41 is a current with a polarity opposite to a charged polarity of toner and prevents charge with a polarity opposite to the charged polarity of the toner from flowing out from the sheet S, so that separation discharge when the sheet S is separated at the separation position A3 is suppressed, resulting in the suppression of toner scattering. The second toner scattering suppression current 42 is a current with a polarity opposite to the charged polarity of the toner and injects charge with a polarity opposite to the charged polarity of the toner to the sheet S, resulting in the improvement of electrostatic attraction force of toner for the sheet S.

The application timings of the first and second toner scattering suppression currents C41 and C42 are controlled by the controller 100. A ratio of the first toner scattering suppression current C41 and the second toner scattering suppression current C42 is decided by a resistance value of the resistance unit 250 provided to the aforementioned wiring L5.

Herein, in the aforementioned image forming apparatus 1, the application of a current to the guide member 245 and the downstream side roller 244 is performed by the second power supply unit 247 which is a common power supply. In this way, it is possible to reduce a power source cost as compared with the case in which independent power supplies are separately provided to the guide member 245 and the downstream side roller 244. However, when power supplies have been made in common, for example, when the total resistance of an electrical path including the downstream side roller 244 increases by deterioration and the like of the conveying belt 241, there is a case in which the first toner scattering suppression current C41 applied to the downstream side roller 244 does not reach a necessary current. When the first toner scattering suppression current C41 is not sufficient, since separation discharge occurs when the sheet S is separated from the conveying belt 241 at the separation position A3, electrostatic attractive force of toner for the sheet S is lost at once. As a consequence, even though toner carried on the sheet S is scattered at once and then a large amount of the second toner scattering suppression current C42 has been supplied to the sheet S from the guide member 245, it is not possible to improve in-apparatus contamination due to toner already scattered.

However, in the present embodiment, the resistance unit 250 is provided to the wiring L5 (corresponding to a second current path), which is connected to the guide member 245, to adjust a current ratio of the first toner scattering suppression current C41 flowing through the wiring L3 (corresponding to a first current path) connected to the downstream side roller 244 and the second toner scattering suppression current C42 flowing through the wiring L5 connected to the guide member 245, so that the first toner scattering suppression current C41 is sufficiently ensured. Thus, it is possible to reliably prevent in-apparatus contamination due to the above-described scattered toner.

Herein, since both the downstream side roller 244 and the guide member 245 are configured by a conductive member made of a metal, their resistance may be ignored. Consequently, a ratio of a current supplied to the downstream side roller 244 and a current supplied to the guide member 245 is decided by a ratio of a resistance value of the conveying belt 241 stretched to the downstream side roller 244 and a resistance value of the resistance unit 250. In the aforementioned embodiment, the resistance unit 250 has been configured with a material, which is equal to that of the conveying belt 241 and has the same thickness as that of the conveying belt 241, while focusing this point.

In this way, the aforementioned current ratios are made equal to each other (1:1), so that it is possible to prevent an application current from being biased to the guide member 245. Thus, it is possible to reliably prevent the first toner scattering suppression current C41 applied to the downstream side roller 244 from being insufficient.

Embodiment

FIG. 12 is a table indicating a result obtained by performing a continuous print test by the aforementioned image forming apparatus 1 in which the resistance unit 250 has been provided to the wiring L5. An output current of the second power supply unit 247 used in the test is 15 μA and an upper limit voltage is 4.5 kV. As the transfer roller 242, an aluminum was used and as the guide member 245, a SUS having a thickness of 0.2 mm was used. Furthermore, after continuous print is performed for 700 K (K=1000) sheets, the first toner scattering suppression current C41 (a current supplied to the downstream side roller 244) and the second toner scattering suppression current C42 (a current supplied to the guide member 245) were measured and the amount of scattered toner in the apparatus was measured. In the table, the "X" indicates that the amount of the scattered toner exceeds a reference amount, the "Δ" indicates that the amount of the scattered toner is approximately similar to the reference amount, and the "O" indicates that the amount of the scattered toner is sufficiently smaller than the reference amount.

According to the table, in a comparison example 1 having no resistance unit 250, it can be understood that the amount of the scattered toner exceeds the reference amount because the first toner scattering suppression current C41 applied to the downstream side roller 244 is small. However, in examples 2 to 4 provided with the resistance unit 250, it can be understood that the resistance value of the conveying belt 241 and the resistance value of the resistance unit 250 are made approximately equal to each other, so that the insufficiency of the first toner scattering suppression current C41 applied to the downstream side roller 244 is solved and the amount of the scattered toner is suppressed to be equal to or less than the reference amount. Herein, the "approximately equal" indicates the case in which a ratio (a log(R2/R1)) of a common logarithm of a resistance value R1 of the conveying belt 241 and a common logarithm of a resistance value R2 of the resistance unit 250 is within the range of 0.8 to 1.2. In an example 5, it can be understood that the resistance unit 250 is configured with the same material as that of the conveying belt 241, so that their resistance values become equal to each other, and the insufficiency of the first toner scattering suppression current C41 applied to the downstream side roller 244 is solved similarly to the examples 2 to 4.

Other Embodiments

In the aforementioned each embodiment and modification, the transfer current C1, the post-transfer current C2, the standby current C3, and the toner scattering suppression current C4 (C41 and C42 in the modification of the embodiment 2) are applied by the constant current control; however, the technology of the present disclosure is not limited thereto and these currents may also be applied by constant voltage control.

Figure 13:
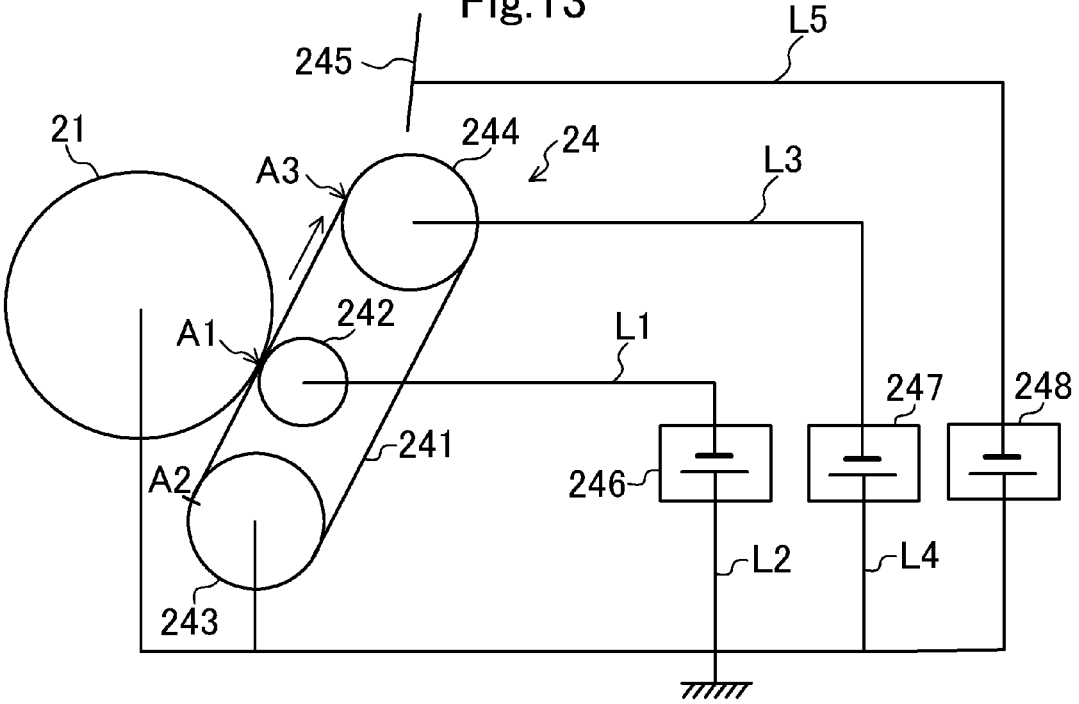
FIG. 13 is a diagram corresponding to FIG. 2, which illustrates another embodiment.

In the aforementioned embodiment 2 and modification thereof, the toner scattering suppression current C4 (C41 and C42 in the modification of the embodiment 2) is applied to the downstream side roller 244 and the guide member 245 by using a common power supply (the second power supply unit 247); however, the technology of the present disclosure is not limited thereto and for example, as illustrated in FIG. 13, a third power supply 248 for applying the toner scattering suppression current C4 to the guide member 245 may also be further provided.

Figure 14:
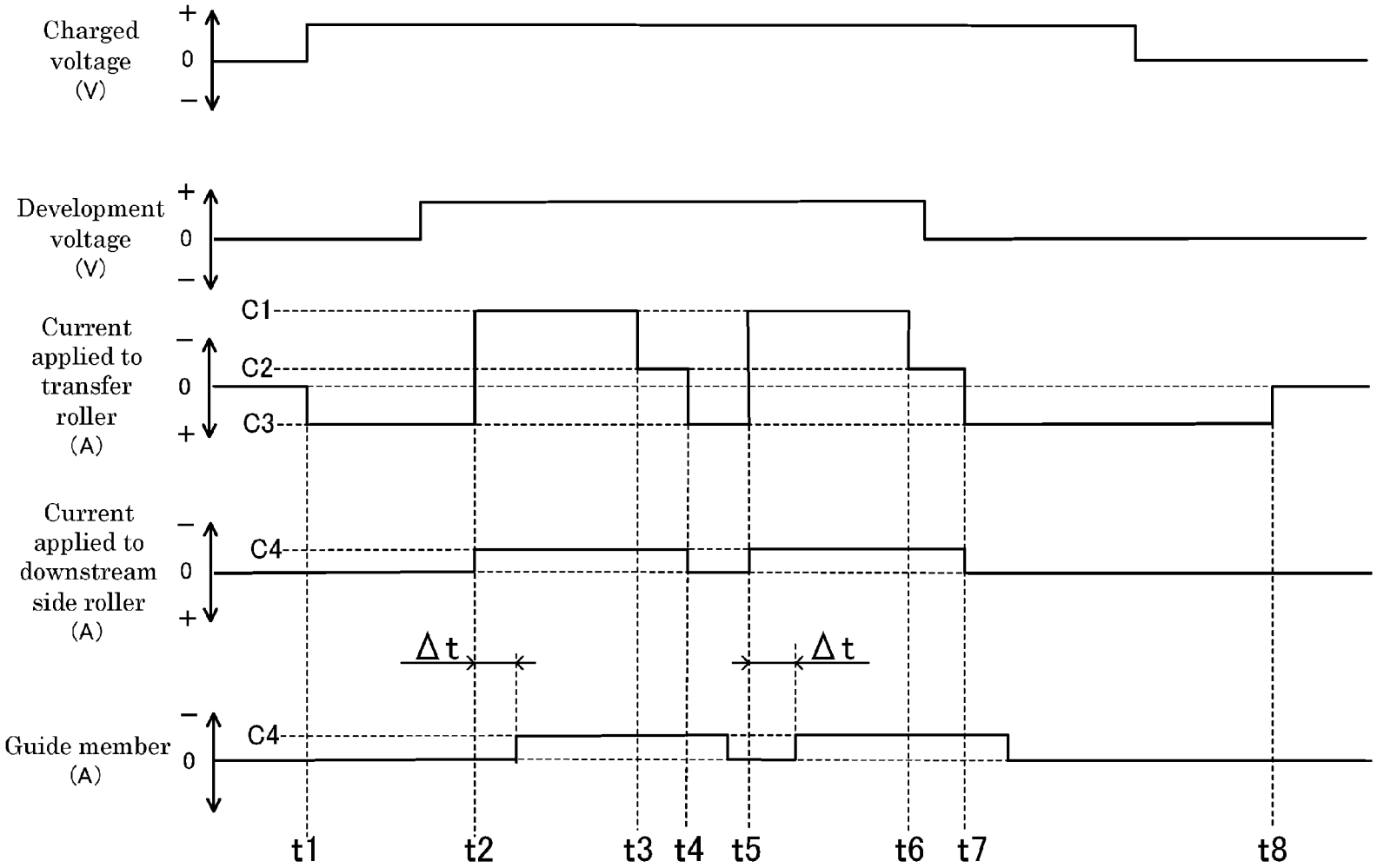
FIG. 14 is a diagram corresponding to FIG. 7, which illustrates another embodiment.

In this case, an example of current control is illustrated in FIG. 14. In this example, the application timing of the toner scattering suppression current C4 for the guide member 245 is delayed by ΔT (sec) than the application timing of the toner scattering suppression current C4 for the downstream side roller 244. The ΔT is equal to a time until the front end of the sheet S passes through an upstream side end of the guide member 245 after passing through the separation position A3 of the conveying belt 241. It is noted that the application timing of the toner scattering suppression current C4 for the downstream side roller 244 may also be the timing t2" at which the sheet front end has reached the separation position A3.

Furthermore, in the aforementioned each embodiment and modification, the example, in which a charged polarity of toner is a positive polarity, has been described; however, the technology of the present disclosure is not limited thereto and may also be applied to an image forming apparatus 1 in which the charged polarity of the toner is a negative polarity.

In the aforementioned each embodiment and modification, the absolute value of the post-transfer current C2 is set to be equal to the absolute value of the toner scattering suppression current C4; however, the technology of the present disclosure is not limited thereto and the absolute value of the post-transfer current C2 may also be set to a value larger than the absolute value of the toner scattering suppression current C4.

As described above, the technology of the present disclosure is useful for an image forming apparatus and particularly, is useful for an image forming apparatus in which a toner image carried on an image carrier is transferred to a sheet conveyed by a conveying belt.

What is claimed is:

1. An image forming apparatus comprising:

an image carrier that carries a toner image;

a conveying belt that forms a nip in contact with the image carrier and conveys a sheet via a nip position;

a transfer roller that transfers the toner image to the sheet at the nip position;

a stretching roller that stretches the conveying belt at a separation position which corresponds to a downstream side in a sheet conveyance direction of the nip position and at which the sheet is separated from the conveying belt;

a first power supply unit that applies a transfer current with a polarity opposite to a charged polarity of toner to the transfer roller until a rear end of the sheet passes through the nip position after a front end of the sheet reaches the nip position; and a second power supply unit that applies a toner scattering suppression current with a polarity opposite to the charged polarity of the toner to the stretching roller until the rear end of the sheet passes through the separation position after the front end of the sheet reaches the separation position, wherein the first power supply unit applies a post-transfer current, which has a polarity opposite to the charged polarity of the toner and has an absolute value equal to or more than an absolute value of the toner scattering suppression current, to the transfer roller until the rear end of the sheet passes through the separation position after the rear end of the sheet passes through the nip position.

2. The image forming apparatus of claim 1, wherein the absolute value of the post-transfer current is smaller than an absolute value of the transfer current.

3. The image forming apparatus of claim 1, further comprising:

a humidity detection unit that detects atmospheric humidity; and a control unit that controls the first power supply unit and the second power supply unit on a basis of the atmospheric humidity detected by the humidity detection unit, wherein the control unit is configured to increase the absolute value of the toner scattering suppression current applied to the stretching roller by the second power supply unit and the absolute value of the post-transfer current applied to the transfer roller by the first power supply unit as the atmospheric humidity detected by the humidity detection unit is high.

4. The image forming apparatus of claim 1, further comprising:

a guide member that guides the sheet at the downstream side in the sheet conveyance direction of the stretching roller, the second power supply unit being configured to apply a current with a polarity opposite to the charged polarity of the toner to the guide member in addition to the stretching roller;

a common current path connected to the second power supply unit;

a first current path branched from the common current path and connected to the stretching roller; and a second current path branched from the common current path and connected to the guide member, wherein a resistance unit is provided to the second current path to adjust a ratio of a current applied to the first current path and a current applied to the second current path.

5. The image forming apparatus of claim 4, wherein the resistance unit has a resistance value approximately equal to a resistance value of the conveying belt.

* * * * *